US006394497B1

(12) United States Patent
Ho

(10) Patent No.: US 6,394,497 B1
(45) Date of Patent: May 28, 2002

(54) DOCUMENT HOLDER WITH A QUICK-RELEASE FASTENING DEVICE

(76) Inventor: Chin-Lien Ho, No. 36, Lo-Yang Rd., Hsi-Tun Dist., Taichung City (TW)

( * ) Notice: Subject to any disclaimer, the term of this patent is extended or adjusted under 35 U.S.C. 154(b) by 0 days.

(21) Appl. No.: 09/876,239

(22) Filed: Jun. 7, 2001

(51) Int. Cl.[7] ..... B42D 3/00

(52) U.S. Cl. ..... 281/29; 24/69 EF; 206/312; 229/67.4; 229/77; 229/84; 281/15.1; 281/36; 383/2; D19/26

(58) Field of Search ..... 281/29, 15.1, 19.2, 281/27, 36, 37, 38, 51; 229/67.1, 67.3, 67.4, 76, 77, 78.1, 78.2, 84; 402/8, 73; D19/26; 206/311, 312; 24/69 EF; 383/2, 31

(56) References Cited

U.S. PATENT DOCUMENTS

| | | | | | |
|---|---|---|---|---|---|
| 1,698,657 | A | * | 1/1929 | Reiter | 24/598.4 |
| 2,188,730 | A | * | 1/1940 | Swab | 229/67.3 |
| 2,192,374 | A | * | 3/1940 | Fritz | 24/686 |
| 2,216,910 | A | * | 10/1940 | Fritz | 24/686 |
| 3,312,384 | A | * | 4/1967 | Heynemann | 229/117.09 |
| 5,871,142 | A | * | 2/1999 | Josephson | 229/120.09 |
| 5,947,279 | A | * | 9/1999 | Lee et al. | 206/232 |

FOREIGN PATENT DOCUMENTS

| | | | |
|---|---|---|---|
| DE | 20005566 | * | 7/2000 |
| FR | 2627435 | * | 8/1989 |

* cited by examiner

*Primary Examiner*—A. L. Wellington
*Assistant Examiner*—Monica Carter
(74) *Attorney, Agent, or Firm*—Akin, Gump, Strauss, Hauer & Feld, L.L.P.

(57) ABSTRACT

A document holder includes a casing and a lid for covering an opening of the casing. A quick-release device includes a strap engaging member fixed on the lid to define a strap engagement space with an entrance for access thereinto. A non-elastic strap has a fixing section fixed to the lid, a pulling section, and a middle section which spans a distal free end of the strap engaging member. A stop member prevents movement of the pulling section into the strap engagement space. An elastic strap is mounted on the casing, and is elastically stretchable to pull the lid to a closed position. Under this condition, the elastic strap passes through the strap engaging member and pulls the middle section into the strap engagement space such that the middle section defines an inverted U-shaped portion that straddles over a portion of the elastic strap in the strap engagement space and a U-shaped portion that inversely straddles over the distal free end of the strap engaging member.

3 Claims, 7 Drawing Sheets

DOCUMENT HOLDER WITH A QUICK-RELEASE FASTENING DEVICE

BACKGROUND OF THE INVENTION

1. Field of the Invention

The invention relates to a document holder, more particularly to a document holder with a quick-release fastening device to facilitate opening of a lid relative to a document holding case.

2. Description of the Related Art

Referring to FIG. 1, a conventional document holder is shown to include a casing consisting of first and second casing halves, and a zipper unit 100 which has first and second zipper halves fixed along the peripheral portions of the first and second casing halves and a runner movably fastened to the zipper halves for closing the first and second casing halves.

It takes time to move the runner of the zipper unit 100 along the peripheral portions of the first and second casing halves in order to close and open the casing. In addition, jamming of the zipper unit relative to the documents disposed in the casing may lead to ruin of the conventional document holder.

SUMMARY OF THE INVENTION

Therefore, the object of this invention is to provide a document holder with a quick-release fastening device to overcome the above-stated drawbacks.

Accordingly, a document holder of the present invention includes a casing, a lid, and a quick-release device. The casing has left and right walls that define therebetween a document chamber, and an opening via which access into the document chamber is possible. The lid is connected to one of the left and right walls and is turnable relative to the casing to a closed position for covering the opening of the casing. The quick-release device includes a strap engaging member, a non-elastic strap, a stop member, and an elastic strap. The strap engaging member has a plate fixed on the lid to define a strap engagement space therebetween. The plate has a distal free end spaced apart from the lid to define therebetween an entrance via which access into the strap engagement space is possible. The non-elastic strap has a fixing section fixed to one of the strap engaging member and the lid, a pulling section opposite to said fixing section and exposed from the strap engaging member and the casing and the lid, and a middle section which extends between the fixing and pulling sections and which spans the distal free end of the strap engaging member. The pulling section is operable to move the middle section. The stop member prevents movement of the pulling section of the non-elastic strap into the strap engagement space. The elastic strap is mounted on the casing and is elastically stretchable to move the lid to the closed position, in which, the elastic strap passes through the entrance of the strap engaging member and pulls the middle section of the non-elastic strap into the strap engagement space such that the middle section defines an inverted U-shaped portion that straddles over a portion of the elastic strap in the strap engagement space and a U-shaped portion that inversely straddles over the distal free end of the strap engaging member, thereby pulling the lid against the casing.

A manually pull of the pulling section results in movement of the inverted U-shaped portion, which in turn, results in movement of the elastic strap from the closed position toward the entrance so that the elastic strap is disengaged from the middle section of the non-elastic strap immediately after passing through the distal free end of the strap engaging member, thereby permitting opening of the lid relative to the casing.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
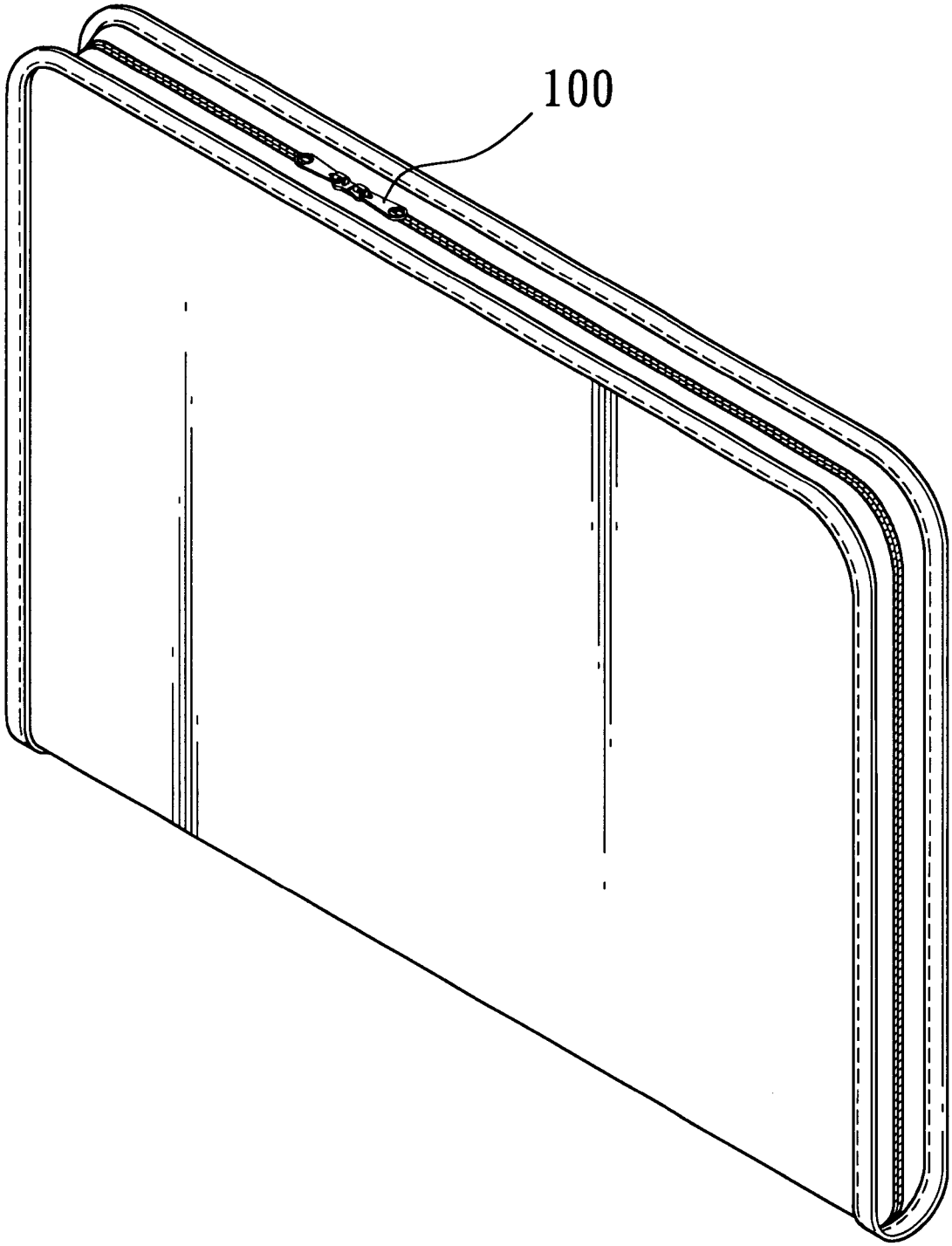
FIG. 1 PRIOR ART
FIG. 1 is a perspective view of a conventional document holder.

Referring to FIGS. 2, 3, 4 and 5, the first preferred embodiment of a document holder 1 of this invention is shown to include a casing 10, a lid 20, and a quick-release device.

As illustrated, the casing 10 has left and right walls that define therebetween a document chamber 101 within which documents 2 are kept, and an opening (not visible) via which access into the document chamber 101 is possible.

The lid 20 is connected to one of the left and right walls and is turnable relative the casing 10 to a closed position for covering the opening of the casing 10.

The quick-release fastening device includes a strap engaging member 30, a non-elastic strap 32, a stop member, and an elastic strap 34. The strap engaging member 30 includes a plate 31 fixed on the lid 20 to define a strap engagement space 310 therebetween (see FIG. 4). The plate 31 has a distal free end 312 spaced apart from the lid 20 to define therebetween an entrance 310" (see FIG. 4) via which access into the strap engagement space 310 is possible. The non-elastic strap 32 has a fixing section 321 fixed to the lid 20, a pulling section 322 that is opposite to the fixing section 321 and that is exposed from the strap engaging member 30, the casing 10 and the lid 20, and a middle section 323 which extends between the fixing and pulling sections 321, 322 and which spans across the distal free end 312 of the strap engaging member 30. The pulling section 322 is operable to move the middle section 323 of the non-elastic strap 32.

Figure 4:
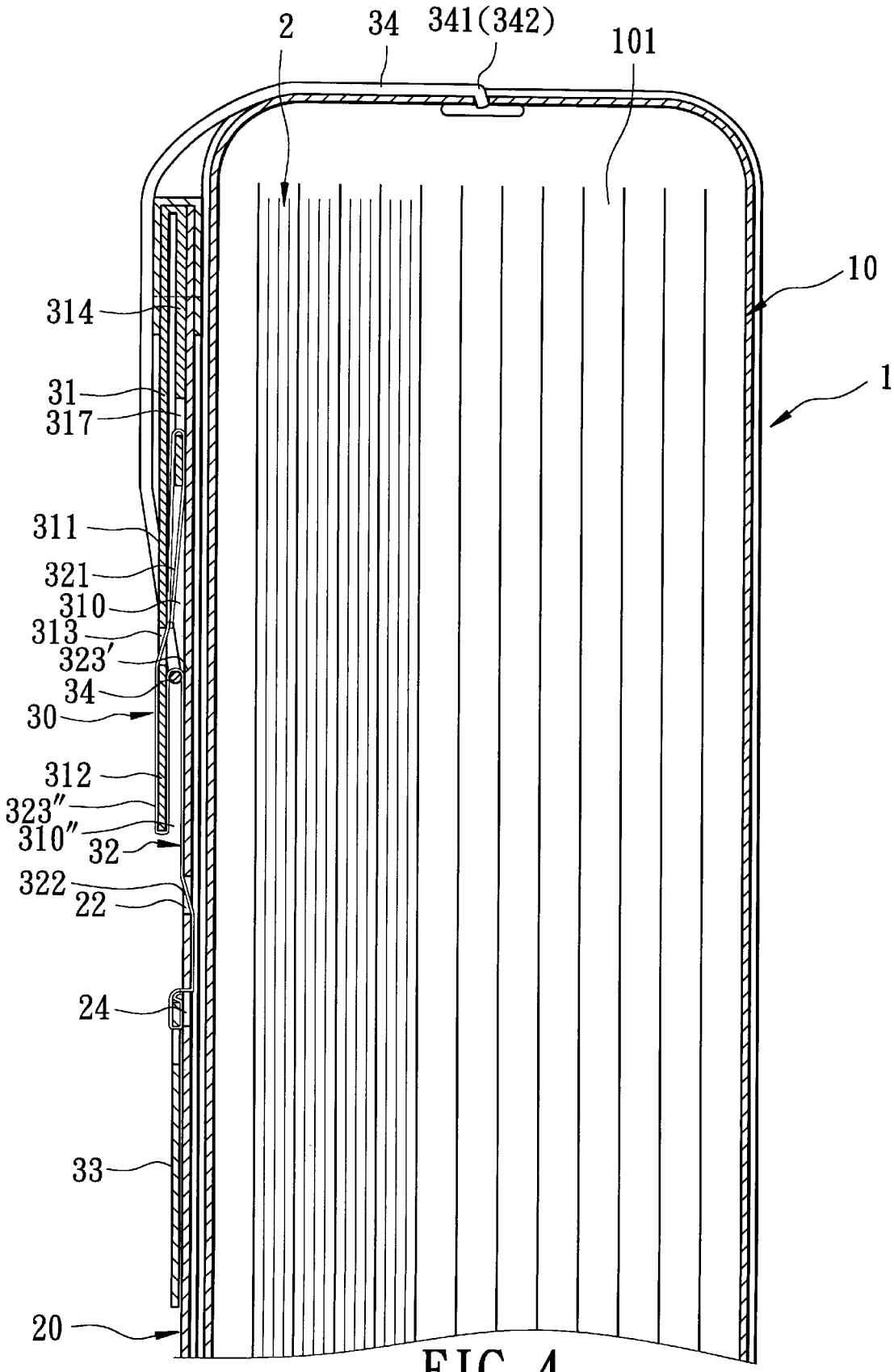
FIG. 4 is a fragmentary sectional view of the first preferred embodiment taken along lines IV—IV in FIG. 2, illustrating the position of an elastic strap when the casing is at a closed position.

A stop member is provided to prevent movement of the pulling section 322 of the non-elastic strap 32 into the strap engagement space 310 (see FIG. 4). The structure of the stop member will be described in the following paragraphs.

Figure 2:
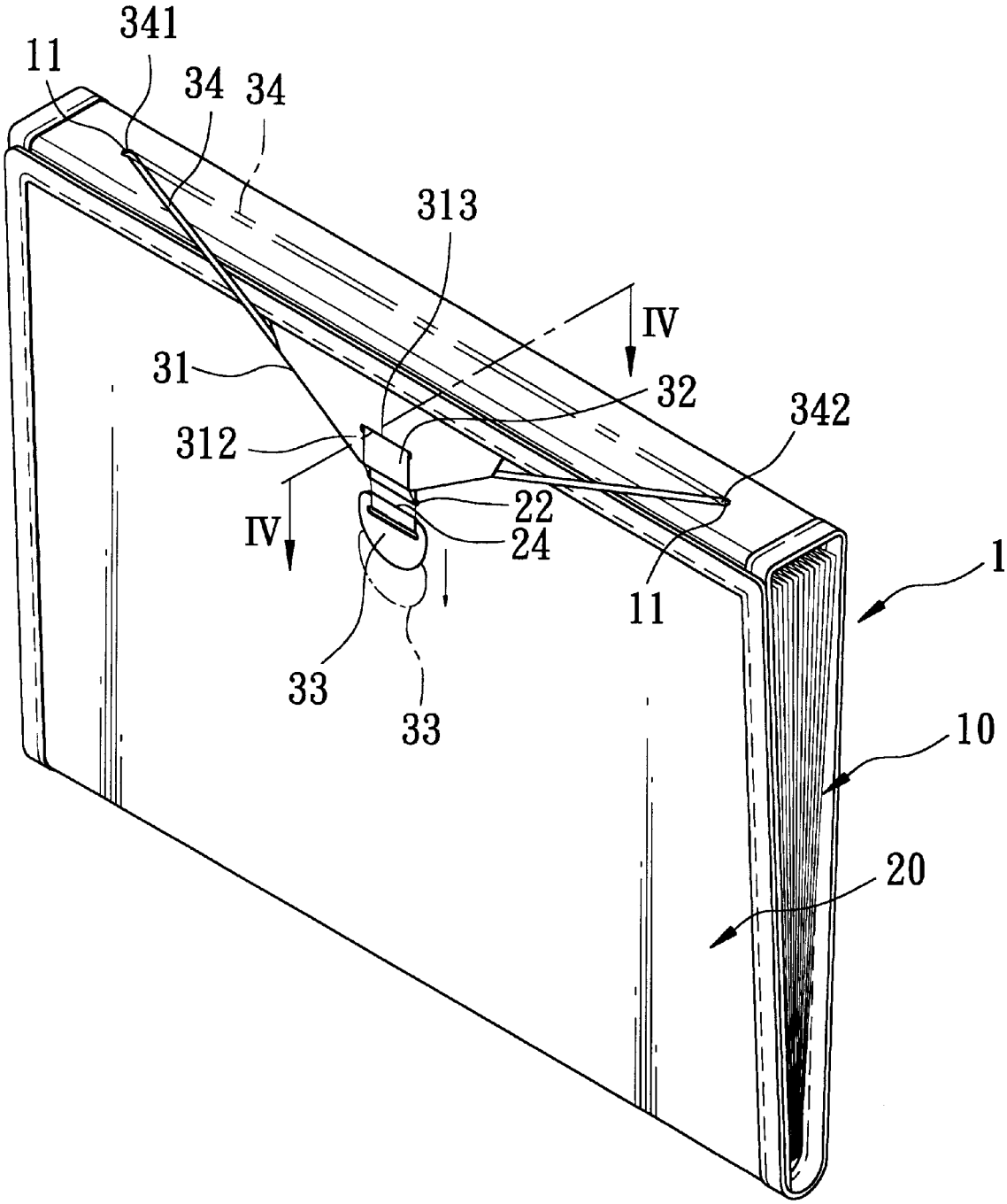
FIG. 2 is a perspective view of a first preferred embodiment of a document holder of the present invention, illustrating how a lid is fastened by a quick-release fastening device to a document holding casing.
Figure 3:
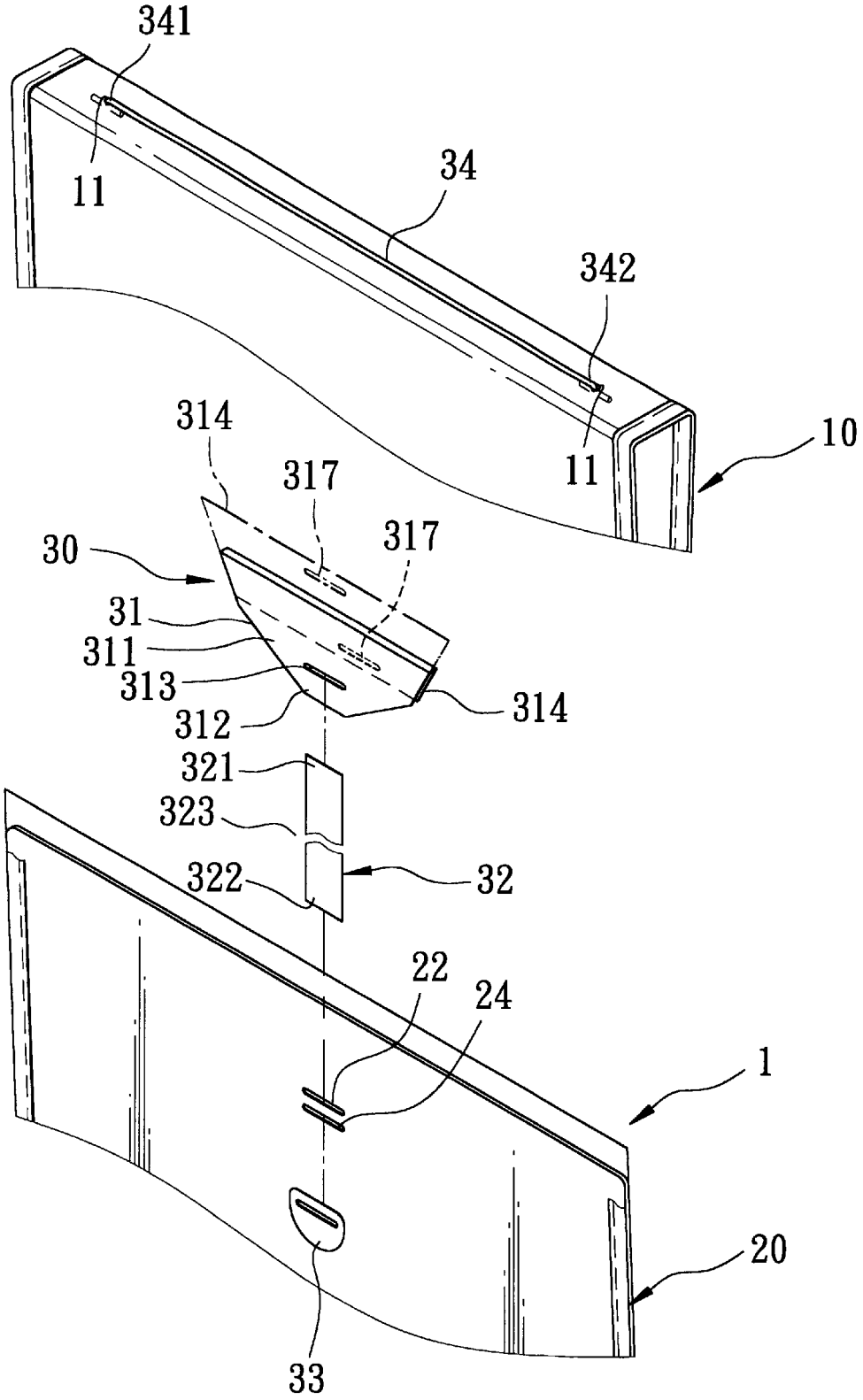
FIG. 3 is a fragmentary exploded view of the first preferred embodiment.

The elastic strap 34 is mounted on the casing 10, and is elastically stretchable to pull the lid 20 to the closed position, as best shown in FIG. 2, in which, the elastic strap 34 passes through the entrance 310" (see FIG. 4) of the strap engaging member 30 and pulls the middle section 323 of the non-elastic strap 32 into the strap engagement space 310 (see FIG. 4) such that the middle section 323 of the non-elastic strap 32 defines an inverted U-shaped portion 323' that straddles over a portion of the elastic strap 34 in the strap engagement space 310 and a U-shaped portion 323" that inversely straddles over the distal free end 312 of the strap engaging member 30, thereby pulling the lid 20 against the casing 10.

Figure 5:
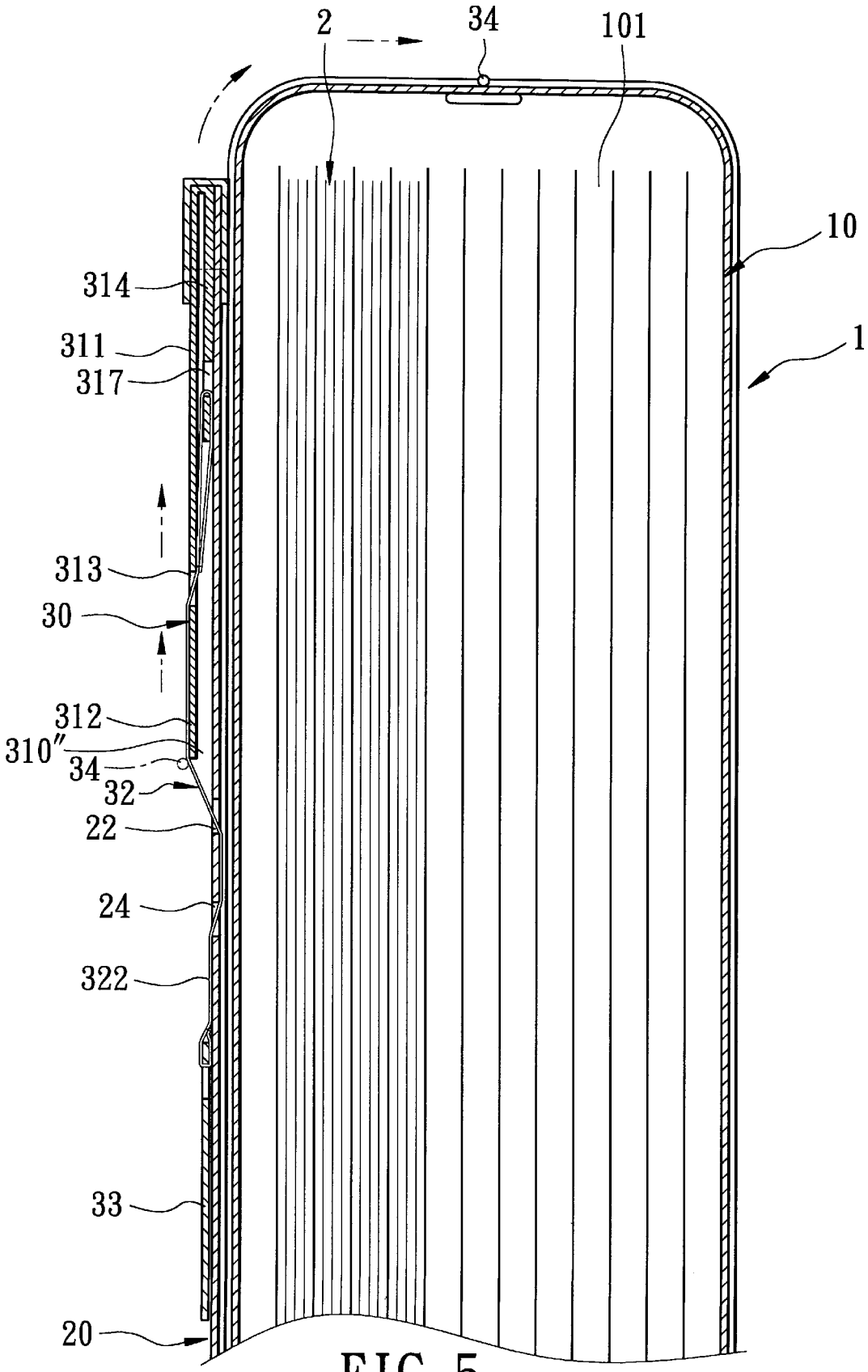
FIG. 5 is a fragmentary sectional view of the first preferred embodiment taken along lines IV—IV in FIG. 2, illustrating the position of the elastic strap when opening the casing.

Referring to FIG. 5, when it is desired to open the lid 20 relative to the casing 10, a manual pull of the pulling section 322 results in movement of the inverted U-shaped portion 323' (see FIG. 4), which in turn, results in concurrent movement of the elastic strap 34 toward the entrance 310" of the strap engaging member 30 so that the elastic strap 34 is disengaged from the middle section 323 (see FIG. 3) of the non-elastic strap 32 immediately after passing through the distal free end 312 of the strap engaging member 30, thereby releasing the lid 20 from the casing 10. The arrows in FIG. 5 show a travelling path of the elastic strap 34 after release from the strap engaging member 30.

In the first preferred embodiment, the strap engaging member 30 is fixed on the lid 20 by stitching and adhesive means. The lid 20 extends integrally from the left wall of the casing 10. The strap engaging member 30 has an inner plate portion 314 formed with a strap engaging hole 317, and an outer plate portion 311 which is formed with a strap passage hole 313 spaced apart from the strap engaging hole 317. The fixing section 321 of the non-elastic strap 32 passes through the strap passage hole 313 and the hole 317 to form a looped portion that hangs on the inner plate portion 314. The elastic strap 34 has two enlarged distal ends 341, 342 trapped within two engaging holes 11 in the casing 10. The stop member preferably includes a pair of spaced apart slots 22, 24 which are formed through the lid 20 via which the pulling section 322 of the non-elastic strap passes 32, and a rigid tab 33 fixed to the pulling section 322. The tab 33 has a dimension greater than that of the slots 22, 24 so as to prevent the pulling section 322 from moving into the strap engagement space 310.

Figure 6:
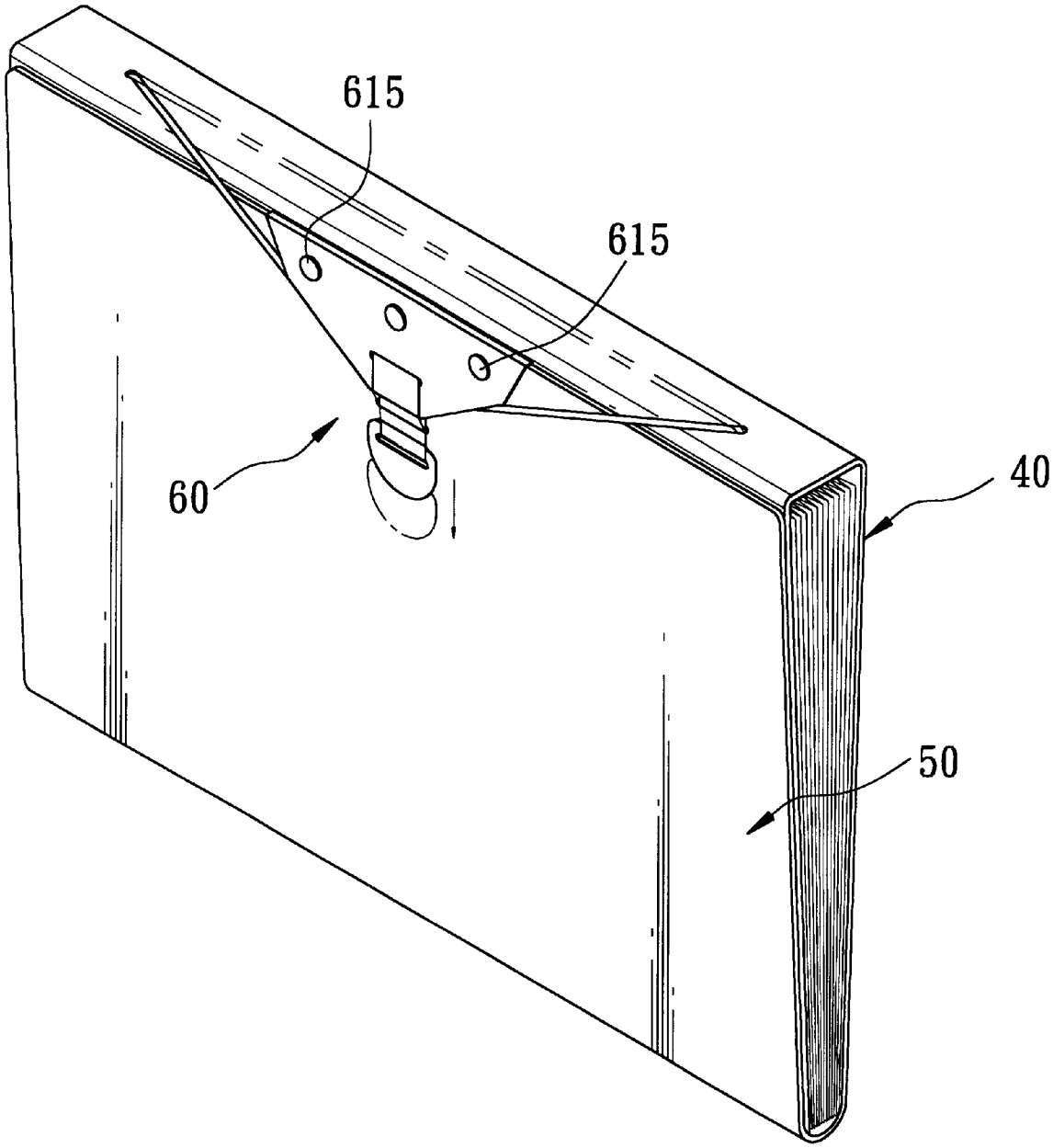
FIG. 6 a perspective view of a second preferred embodiment of a document holder of the present invention, illustrating how a lid is fastened by a quick-release fastening device to a document holding casing.
Figure 7:
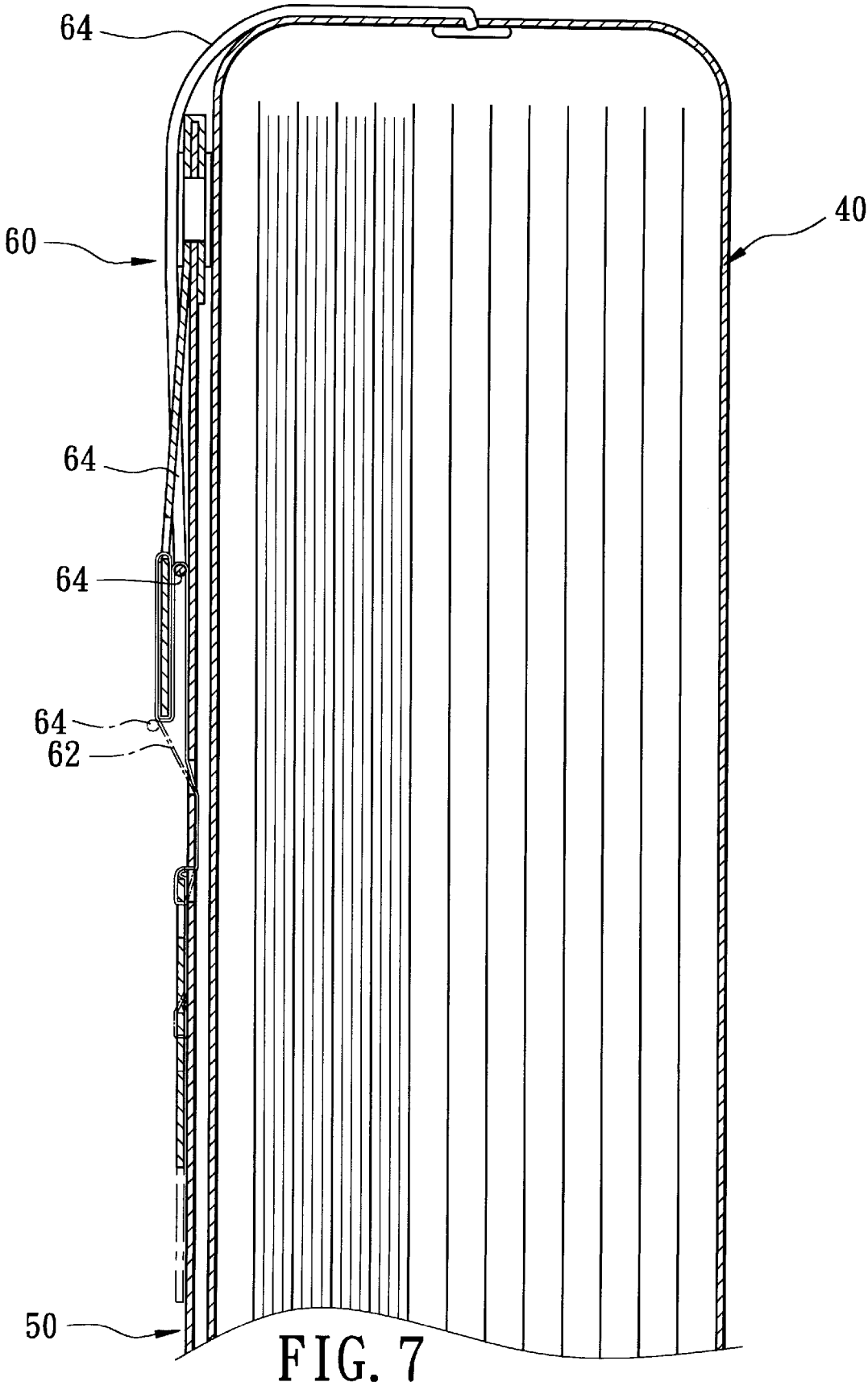
FIG. 7 is a fragmentary sectional view of the second preferred embodiment, illustrating the position of an elastic strap when the casing is at a closed position.

Referring to FIGS. 6 and 7, a second preferred embodiment of the present invention is shown to be generally similar to the first preferred embodiment. The main difference resides in that the strap engaging member 60 is fixed on the lid 50 of the casing 40 by rivets 615 and that the looped portion of the non-elastic strap 62 hangs on the outer plate portion 616 of the strap engaging member 60.

Since a mere pull at the pulling section of the non-elastic strap 32, 62 results in removal of the elastic strap 34, 64 from the strap engaging member 30, 60, the aforesaid drawbacks encountered in the prior art can be eliminated.

With this invention thus explained, it is apparent that numerous modifications and variations can be made without departing from the scope and spirit of this invention. It is therefore intended that this invention be limited only as indicated in the appended claims.

I claim:

1. A document holder comprising:

a casing having left and right walls that define therebetween a document chamber, and an opening via which access into said document chamber is possible;

a lid connected to one of said left and right walls and turnable relative to said casing to a closed position for covering said opening of said casing; and a quick-release device including a strap engaging member having a plate fixed on said lid to define a strap engagement space therebetween, said plate having a distal free end spaced apart from said one of said left and right walls to define therebetween an entrance via which access into said strap engagement space is possible, a non-elastic strap having a fixing section fixed to one of said strap engaging member, said casing and said lid, a pulling section opposite to said fixing section and exposed from said strap engaging member and said casing and said lid, and a middle section extending between said fixing and pulling sections and spanning said distal free end of said strap engaging member, said pulling section being operable to move said middle section, a stop member for preventing movement of said pulling section of said non-elastic strap into said strap engagement space, and an elastic strap mounted on said casing and said lid, and being elastically stretchable to pull said lid to said closed position, in which, said elastic strap passes through said entrance and pulls said middle section of said non-elastic strap into said strap engagement space such that said middle section defines an inverted U-shaped portion that straddles over a portion of said elastic strap in said strap engagement space and a U-shaped portion that inversely straddles over said distal free end of said strap engaging member, thereby pulling said lid against said casing;

whereby, a manually pull of said pulling section results in movement of said inverted U-shaped portion, which in turn, results in movement of said elastic strap from said closed position toward said entrance so that said elastic strap is disengaged from said middle section of said non-elastic strap immediately after passing through said distal free end of said strap engaging member, thereby permitting opening of said lid relative to said casing.

2. The document holder as defined in claim 1, wherein said plate of said strap engaging member has a strap hole via which said fixing section of said non-elastic strap passes through to form a loop portion that hangs on said plate.

3. The document holder as defined in claim 1, wherein said stop member includes a pair of spaced apart slots which are formed in said lid and through which said pulling section of said non-elastic strap passes, and a rigid tab fixed to said pulling section and having a geometric dimension greater than that of said slots so as to prevent said pulling section from moving into said strap engagement space.

* * * * *